United States Patent [19]

Habegger

[11] 4,402,272

[45] Sep. 6, 1983

[54] RAIL-TRANSPORTATION SYSTEM

[76] Inventor: Willy Habegger, CH-3626 Hünibach bei Thun, Switzerland

[21] Appl. No.: 261,501

[22] Filed: May 7, 1981

[30] Foreign Application Priority Data

May 10, 1980 [DE] Fed. Rep. of Germany ..... 3018009

[51] Int. Cl.[3] ..... B61B 5/02; B61B 9/00; E01B 25/00

[52] U.S. Cl. ..... 104/178; 104/119; 104/196; 104/279; 105/144; 105/148; 188/33

[58] Field of Search ..... 104/25, 173 R, 174, 104/178, 229, 279, 280, 196, 117, 125, 74, 298, 140, 138, 118, 82, 198, 119; 105/153, 141, 148, 144, 145, 150, 151, 453, 436; 52/223 R; 14/16.1; 238/134, 135; 198/326, 329; 188/33

[56] References Cited

U.S. PATENT DOCUMENTS

| | | | |
|---|---|---|---|
| 247,571 | 9/1881 | McGlashan | 105/153 |
| 805,166 | 11/1905 | Steinberger | 104/279 |
| 963,589 | 7/1910 | Landin | 105/436 |
| 994,879 | 6/1911 | Seeberger | 198/329 |
| 1,631,030 | 5/1927 | Harding | 104/196 |
| 2,105,416 | 1/1938 | Hansen | 104/279 |
| 2,633,301 | 3/1953 | Esch | 238/135 |
| 2,645,090 | 7/1953 | Kinneman et al. | 52/223 R |
| 3,857,340 | 12/1974 | Wright | 104/173 ST |
| 3,890,904 | 6/1975 | Edwards | 104/118 |
| 3,971,598 | 7/1976 | Rudge | 14/16.1 |
| 4,000,702 | 1/1977 | Mackintosh | 104/118 |
| 4,003,314 | 1/1977 | Pearson | 104/173 ST |
| 4,078,500 | 3/1978 | Zuppiger | 104/173 R |

*Primary Examiner*—Robert B. Reeves
*Assistant Examiner*—Donald Hajec
*Attorney, Agent, or Firm*—Karl F. Ross; Herbert Dubno

[57] ABSTRACT

A rail-transportation system had a longitudinally elongated rail assembly along which extends a longitudinally moving traction element connected to a plurality of longitudinally spaced cars riding on the assembly. The rail assembly consists of upper and lower longitudinally extending rails interconnected by struts and normally formed thereby into a rigid framework or box-beam construction. The car has a car body to one transverse side of the rails, an upper wheel to the other transverse side of the rails and riding on the upper rail, and a lower wheel to the one side of the rails and bearing on the lower rail in a transverse direction opposite that of the upper wheel. The car may have inner and outer frames connected together by a parallelogrammatic linkage connected to a guide rail between the upper and lower rails to maintain a load-carrying platform of the car horizontal even when the various rails are all inclined to the horizontal.

28 Claims, 15 Drawing Figures

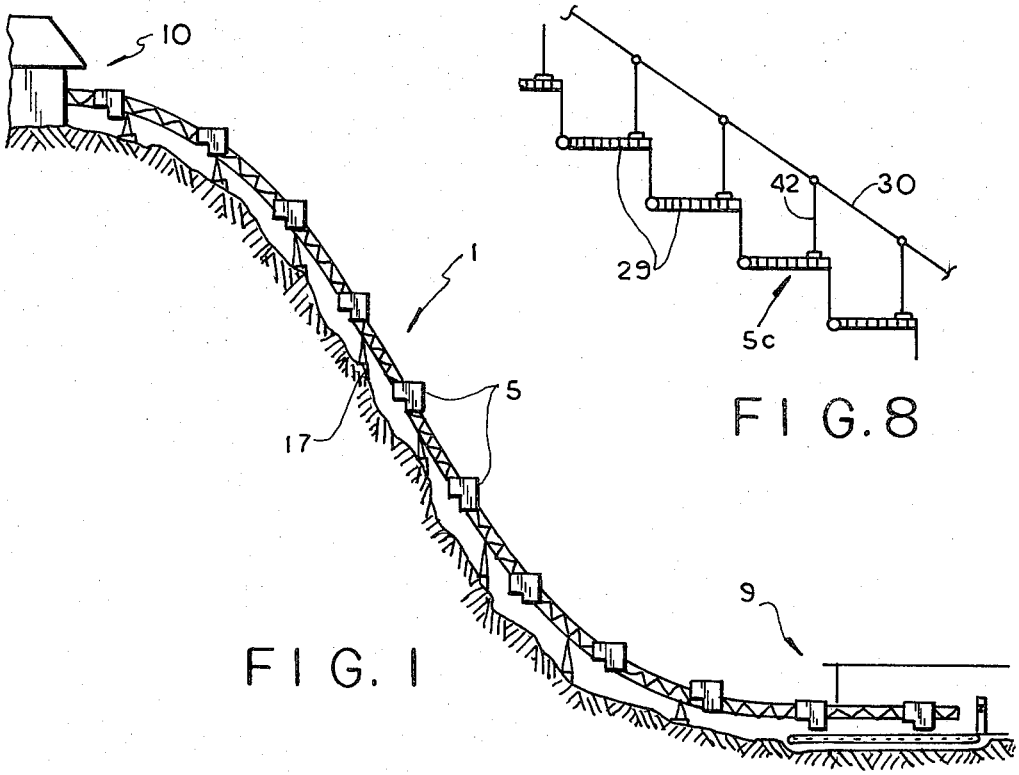
FIG. 1
FIG. 8
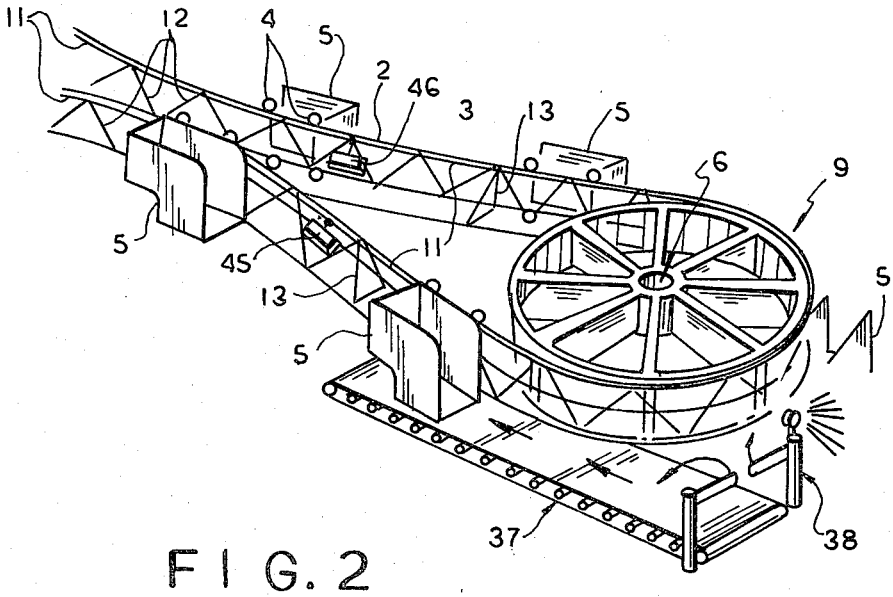
FIG. 2

FIG. 4A
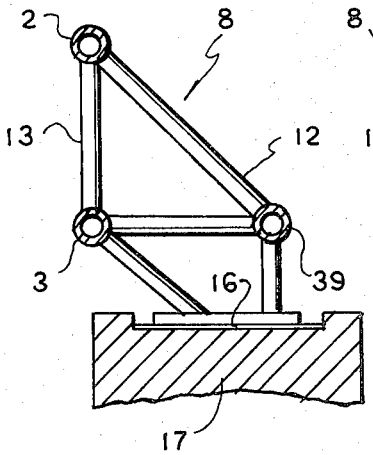
FIG. 4B
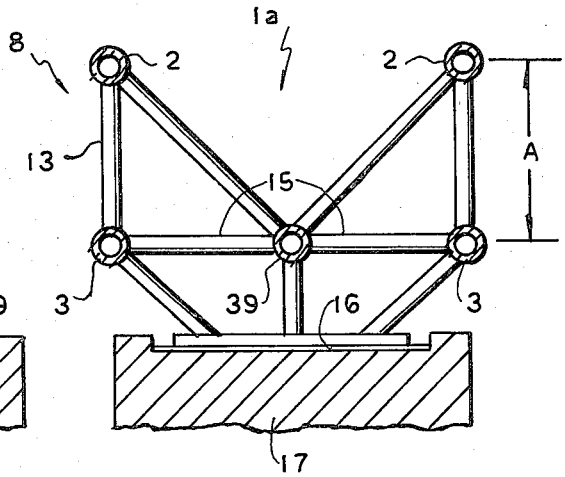
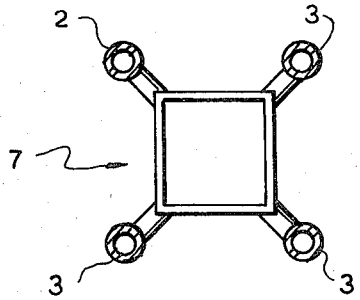
FIG. 4C
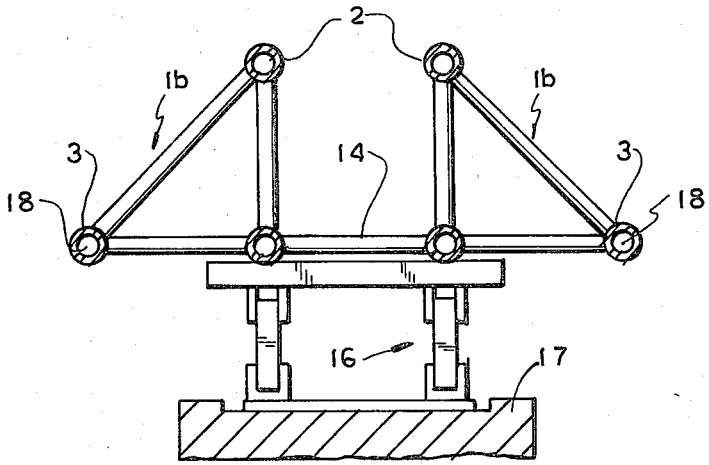
FIG. 4D

RAIL-TRANSPORTATION SYSTEM

FIELD OF THE INVENTION

The present invention relates to a rail-transportation system. More particularly this invention concerns such a system usable for moving passengers and/or freight up and down inclines.

BACKGROUND OF THE INVENTION

A standard rail-transportation system has two horizontally parallel rails on which ride a plurality of cars that are joined together into trains and pulled or pushed by an engine. Such a system is enormously expensive, and due to the necessity of having to make up trains does not give much flexibility of use.

A one-rail cog railway is also known which has one large rail provided on its underside with a rack that meshes with a gear carried on an engine that pushes or pulls a train of cars that ride on the rail. This system is particularly useful in cold mountainous terrain, as the positive engagement between cog gear and rack allows considerable tractive effort to be employed, and all the vital drive parts are hidden out of harm's way under the rail where snow and ice cannot foul them. This system, nonetheless, is quite expensive to build and requires the use of trains which inherently reduces the frequency of trips.

Various other systems are known, such as overhead monorails, which can only be built at enormous expense, and overhead suspended railways whose rails are hung from catenary suspension cables, which are experimental and of dubious safety.

Cable railways where the individual cars ride on their own tracks and are clamped to normally underground cables are known, but have proven impractical. Such systems usually lose a large percentage of their energy in displacement of the traction cable which obviously is a large item that cannot be kept moving over its various guides and rollers without considerable loss of energy to friction.

OBJECTS OF THE INVENTION

It is therefore an object of the present invention to provide an improved rail-transportation system.

Another object is to provide such a system which can be made at relatively low cost, but which nonetheless can provide frequent and reliable transportation.

Yet another object is the provision of such a system which is relatively weather-proof.

SUMMARY OF THE INVENTION

These objects are attained according to the instant invention in a rail-transportation system having a longitudinally elongated rail assembly along which extends a flexible traction element, normally a cable or chain. A car can ride along this rail assembly, being attached to the traction element so it can be pulled along thereby as same is displaced longitudinally by an appropriate drive. More particularly the rail assembly comprises longitudinally extending and generally parallel upper and lower rails and struts interconnecting them. The car is mainly to one transverse side of the rail assembly and has at least one upper roller to the other transverse side of the assembly and engaging the upper rail in a transverse direction toward the car body, while a lower roller is provided on the same transverse side of the assembly as the car and engages the lower rail generally in a direction opposite that of the upper roller.

With the system according to the present invention laterally mounted cars can be provided all along the rail assembly. In fact they can, according to one variant of the instant invention, be formed as individual stair treads and spaced very closely together to make the system into a cantilevered escalator. The cars can move relatively close to the ground, next to the rail assembly, so that extensive safety equipment need not be provided, as in a standard cablecar, since there is no danger of falling a long distance should the car become detached due to some accident or catastrophe.

The system according to this invention is normally intended to operate at low speed, normally below 1.0 m/sec, but can easily operate at up to 1.5 m/sec. At the lower speed, with a spacing of 5 sec or 7.5 m between successive cars it is possible to move 2160 passengers/-hour, assuming 3 passengers can fit in one car. The passengers get on a car while it is moving and similarly get off while it is moving, pater-noster fashion. Normally the system can easily transport 300–1000 passengers per hour, normally through distances of at most 500 m.

The system according to the instant invention is therefore intended for use as a so-called "people mover" which carries passengers and their baggage limited distances, and which normally operates like a so-called pater noster, continuously and automatically. It is possible to incorporate into the system according the instant invention a moving-sidewalk system for bringing the passengers up to the speed of the cars as they get on, and for allowing them to get off onto something moving the same speed as they are. Electronic-eye controlled gates can be used, or turntable-type systems where the passengers get onto and off a turntable at the center, so that as they move radially outwardly from the center they are brought up to speed and vice versa. Of course the system can be stopped if necessary to accommodate persons in wheelchairs or others having difficulty getting on or getting off.

According to further features of the invention the rail assembly is a rigid honeycomb or lattice arrangement, so that in effect a box beam is formed of the various rails and struts rigidly interconnecting them. In order to give the system good lateral rigidity a rigid member or rail is provided horizontally offset from the top or bottom rail, and connected to both the top and bottom rails by struts to rigidify the entire assembly. The resultant box beam can be of square vertical cross section. Normally triangular section is adequate, with the reinforcing member being provided on the outside of the lower rail, joined to both of the rails by struts or longitudinal stiffening plates. When two sections of the rail assembly are provided immediately adjacent each other it is possible to integrate them into a single box beam for a considerable saving in construction costs. Such an arrangement can be of rectangular vertical cross section or can be two such box beams of triangular section joined by an additional set of horizontal struts. When such a double system has closely longitudinally space cars on both sides, the arrangement remains in good balance and can therefore be built at low cost.

In order to compensate for relative longitudinal creep of the rail assembly and its supports due to normal thermal expansion and contraction, means is provided permitting such movement. This means may include a layer of low-friction material, such as polytetrafluorethylene, between the bases and the rail assembly or elements supporting the rail assembly.

According to another feature of this invention the rails are constituted as hollow tubes and have countoured edges engageable with the respective rollers and the rollers are shaped complementarily to the respective edges. The tubes can be of polygonal section and formed with ridged edges having no horizontal surfaces, that is with a corner up like a roof. Thus snow and ice cannot collect on them, to make the system particularly winterproof. This winterproofing can be aided even further by providing snow- and ice-removing scrapers or brushes on the cars so that any snow or ice that does stick to the rails can be removed automatically from them. Such tubular rails can also be provided with internal heating wires to help snow removal. When the system according to the instant invention is set up as an escalator, as described above, the instant invention therefore is a winterproof escalator suitable for outside use, something that has hitherto never existed. What is more the tubular shape of the rails makes it readily easy to longitudinally prestress them internally, as a tension element, such as a cable, can pass through the rail where it is in the theoretically perfect place to tension the rail and where it is completely safe from the weather.

In accordance with another feature according to the instant invention the car body includes an outside frame carrying the four upper and two lower rollers that normally support the car on the rails, an inside frame adapted to support a load, and a parallelogrammatic linkage between these frames for maintaining the inside frame horizontal even when the outside frame is tipped. This is achieved according to the invention by providing a guide rail in the rail assembly between the upper and lower rails and generally parallel thereto. The parallelogrammatic linkage responsible for maintaining the inner frame level has at least one guide roller riding on this guide rail. In order to provide some adjustability, the guide rail is slidably mounted on vertical struts of the rail assembly so that it can be fixed at any of a plurality of vertically offset locations along these vertical struts. Once the proper position is set, the guide rail can be welded in place. Normally cushioned guide rollers are employed to insure smooth adjustment with minimal noise.

The car body according to this invention is normally formed as a vessel open, relative to the normal forward travel direction, laterally and/or backwardly. The laterally or backwardly directed entrance or egress opening may be provided with a ramp so that rollable conveyances, such as dollies, wheelchairs, baby carriages, wheeled luggage, or the like can readily get on and off the car. The car bodies according to the instant invention can be built at very low cost.

With the system according to the instant invention it is possible for the cars to constitute the sole support for the traction element. Thus one of the main problems of standard cablecar-type systems, that much energy is lost just overcoming friction in the guides and wheels that support the cable in its run, is almost wholly obviated. In fact some blind cars, or cars not used for carrying any load can be employed solely to support the traction cable. Of course, if the cars are too widely spaced, it is possible to provide appropriate rollers or guides for the traction element. In any event, at turnaround stations at the ends of the runs the cable normally passes over a large-diameter drive or idler wheel having flanges forming arcuate continuations of the upper and lower rails. Normally means is provided for equal-speed motion for the passengers and even freight at the turnaround locations, by using a turntable-type system as described above or an appropriate conveyor belt.

The system according to the instant invention is therefore perfectly usable as a so-called people mover, suitable for displacing persons and limited amounts of freight over relatively short distances at low speed. The system is quite compact and inexpensive to install, and in fact is of such very short vertical size that it can be used in environments where the main objection to other systems has been their considerable size and unattractive appearance.

DESCRIPTION OF THE DRAWING

FIG. 1 is a side view of a system according to the instant invention;

FIG. 2 is a perspective top view of the system of FIG. 1;

FIGS. 4A, 4B, 4C, and 4D are cross sections through various rail assemblies according to this invention;

FIG. 8 is a largely schematic side view of another system according to the present invention;

SPECIFIC DESCRIPTION

Figure 3:
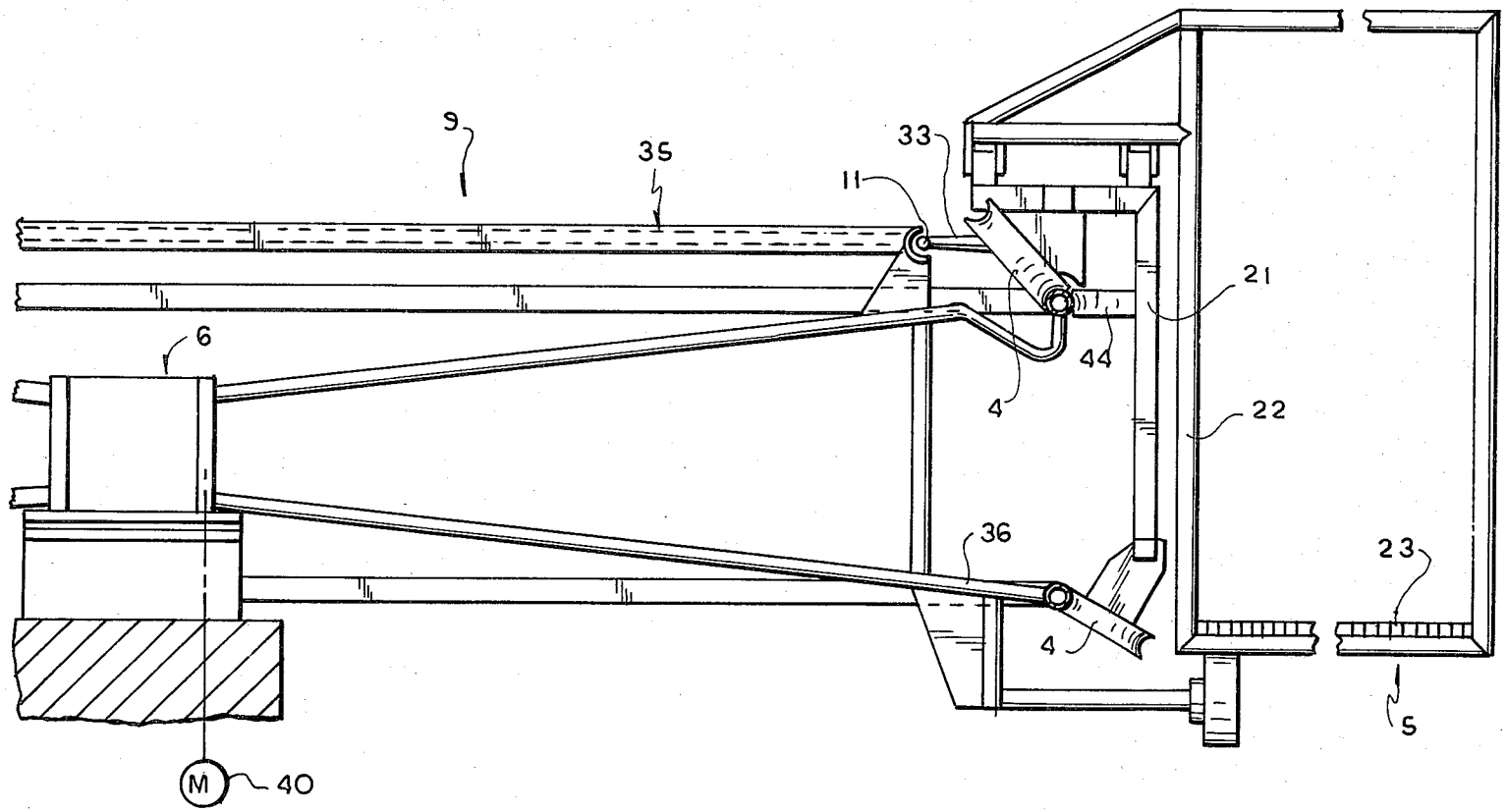
FIG. 3 is a large-scale vertical section through a detail of FIG. 2.

A rail-transportation or people-mover system according to the instant invention has as shown in FIG. 1 a rail assembly 1 having an upper rail 2 and a lower rail 3. Cars 5 ride via upper and lower rollers 4 on the rails 2 and 3 so that these cars can move longitudinally along the rail assembly 1. As seen in FIG. 4A the rail assembly 1 is formed as a framework or box beam 7 and has vertical struts 13 interconnecting the rails 2 and 3 and horizontal and inclined struts 12 connecting the rails 2 and 3 with another lower rail 39 level with and parallel to the lower rail 3. The rail assembly 1 sits via a polytetrafluorethylene layer 16 on footings or foundation supports 17 so that the assembly 1 can move longitudinally relative to the foundations 17 to compensate for thermal expansion and contraction.

FIG. 4B shows a double rail assembly **1*a* wherein a single outer lower rail 39 is used. In this manner the cantilevered cars 5 on one side of the assembly 1*a* will counterbalance those on the other. The system of FIG. 4C has a square-section metal beam 7 carrying on each side an upper rail 2 and a lower rail 3 for the same counterbalancing effect. In FIG. 4D two triangular-section rail assemblies 1*b* are shown having lower rails 3 spaced inwardly, relative to the cars 5, of the respective upper rails 2, so that the lower rails 39 are directly below the respective upper rails 2. Horizontal struts 14 join the two lower rails 39, and the entire arrangement is supported via links 16 pivoted at their upper ends on the rail assemblies 1*b* and on their lower ends on the foundation 17** to compensate again for thermal expansion and contraction.

The system according to the instant invention normally uses an endless rail assembly that can extend along an incline and that has as shown in FIGS. 1 and 2 a drive station 9 at one end and an idler turnaround station 10 at the other end. The drive station 9 as shown in FIG. 3 has a wheel 6 normally driven by a heavy-duty electric motor 40 through an appropriate heavy-duty stepdown transmission. This wheel 6 has an upper flange 35 which forms an arcuate continuation of the upper rails 2 and a lower flange 36 that forms an arcuate continuation for the lower rails 3.

In addition according to this invention an endless traction cable 11 also is reeved over the upper flange 35 and therefore is advanced longitudinally by the motor 40. This cable 11 is releasably connected to the cars 5 by short connector arms 33 which serve normally as the sole support for the cable 11.

Figure 6:
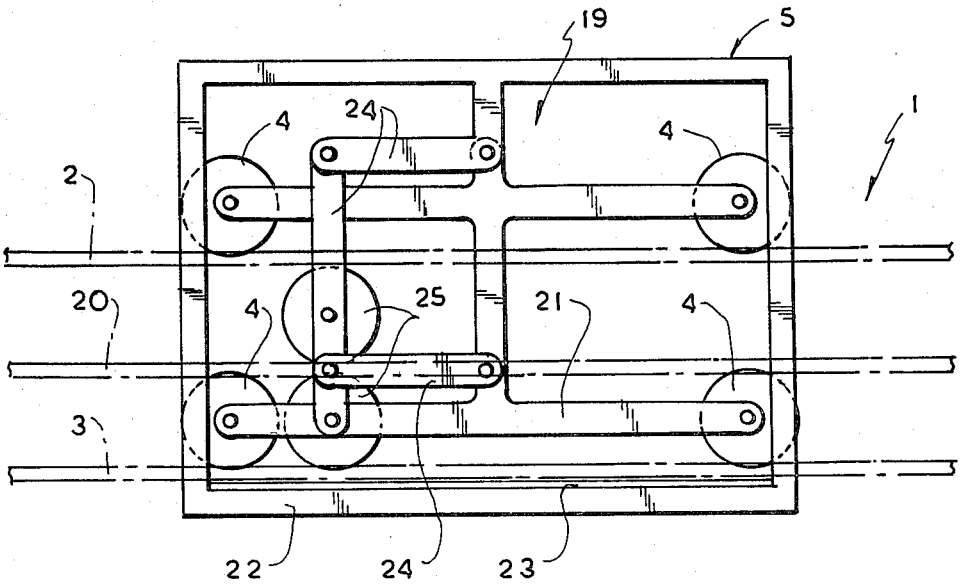
FIGS. 6 and 7 are side views illustrating an automatic-righting arrangement for the system of this invention.
Figure 7:
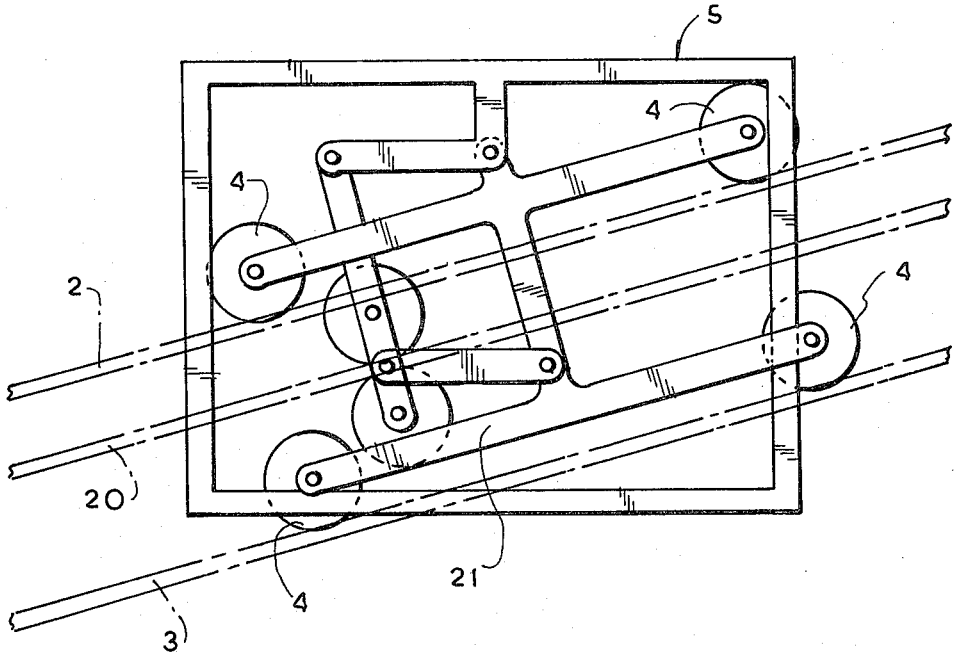

Each of the cars 5 has as shown in FIGS. 6 and 7 an outer frame 22 supporting a floor 23 and an inner frame 21 carrying the wheels 4 and connected via a parallelogrammatic linkage 19 formed of links 24 and guide rollers 25 to a guide rail 20 extending parallel to and between the upper rail 2 and lower rail 3. The parallelogrammatic linkage 19 is set up, as can be seen by a comparison of FIGS. 6 and 7, to maintain the floor 23 of the car 5 horizontal, even when the rails 2, 3, and 20 are inclined to the horizontal.

Figure 9A:
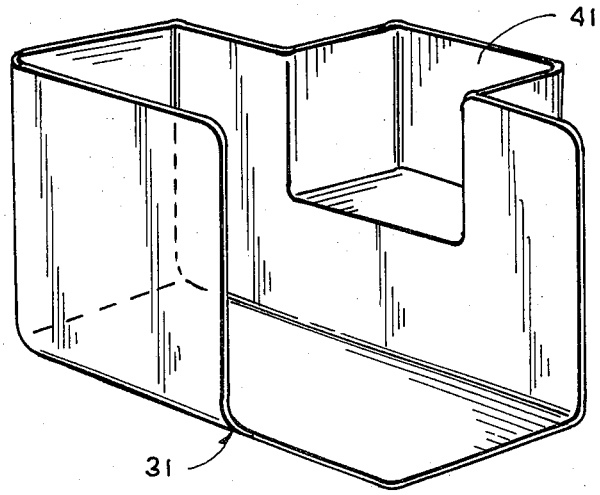
FIGS. 9A, 9B, and 9C are perspective views illustrating various cars according to this invention.
Figure 9B:
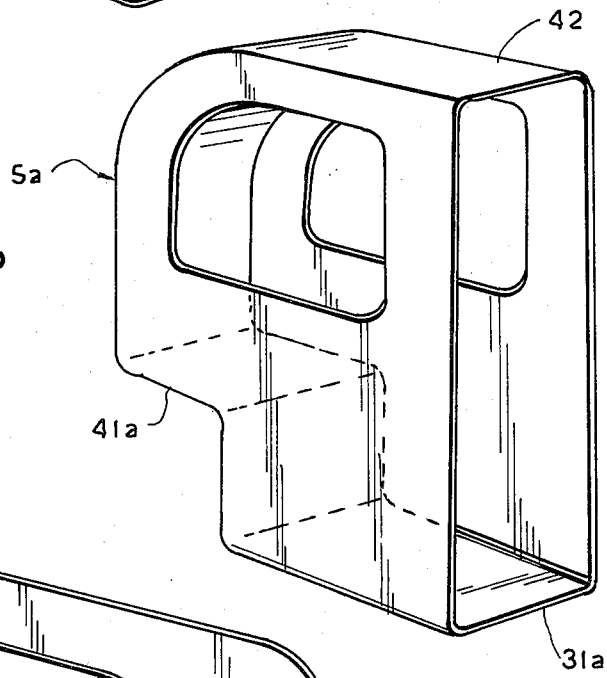
Figure 9C:
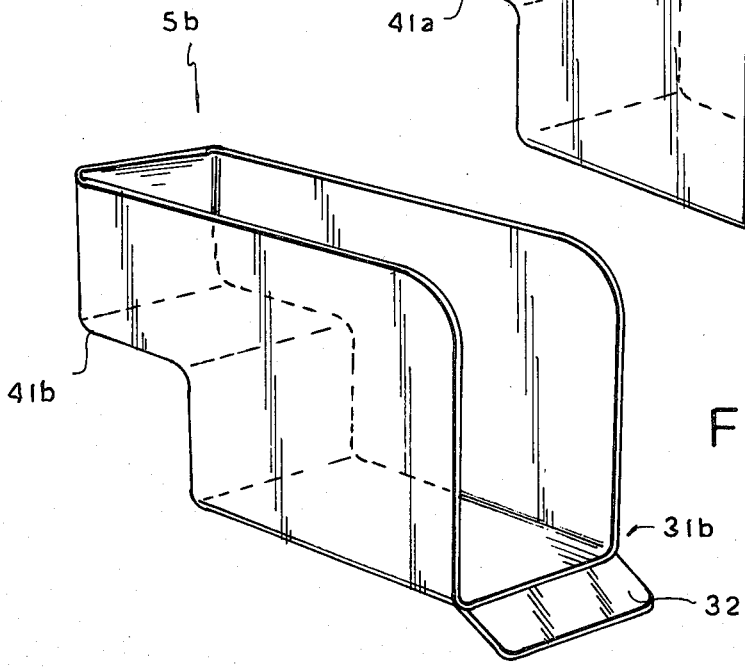

As shown in FIG. 9A it is possible for a car 5 to have both a lateral and a rearward entrance and exit opening 31, as well as a laterally facing seat 41. The car 5*b* of FIG. 9B has a rearward opening 31*a*, a rearwardly facing seat 41*a* and a roof 42. The car 5*b* of FIG. 9C has a rearwardly directed seat and opening 41*b* and 31*b* as well as a short ramp 32 at the opening 31*b*.

FIG. 8 shows how the cars 5*c* can actually be formed as individual stair treads 29, with a flexible railing 30 mounted via posts 42 on the treads 29. Thus the system according to the instant invention can also serve as a weatherproof escalator.

Figure 5:
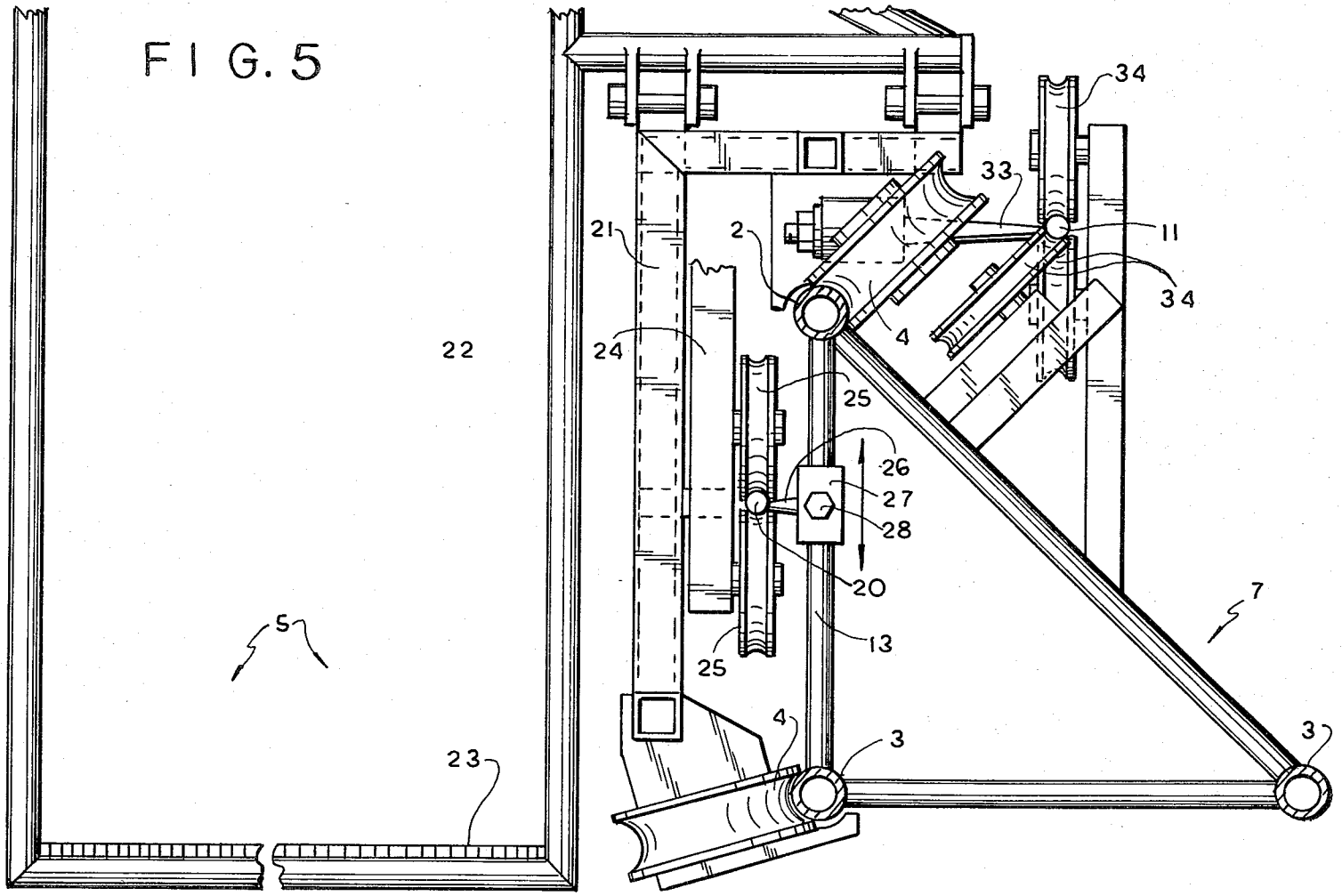
FIG. 5 is a large-scale vertical section through a detail of FIG. 1.

FIG. 5 shows in more detail how the guide rail 20 can be mounted on a sleeve 27 vertically slidable on a vertical strut 13 and securable anywhere therealong by means of a lock bolt 28. Once the position of the rail 20 is adjusted to maintain the respective car floor 23 perfectly horizontal at all times, its sleeve 27 is normally spot-welded in place.

In addition FIG. 5 shows how, if the cars 5 are spaced too far apart, the traction cable can be held between guide rollers or pulleys 34. Tensioners 45 (FIG. 2) may be provided between adjacent cars.

One of the rails 2 or 3 at least is normally tubular and is provided internally with a prestressing cable 18 as shown in FIG. 4D. This cable 18 may, in addition to prestressing the respective rail 3, contain one or more insulated conductors allowing control signals or electrical energy to be transmitted through the rail assembly. One of the conductors of such a wire can be a heater so as to heat the respective rail and therefore prevent ice and snow from adhering to it.

It is also possible as shown in FIG. 3 to provide a scraper 44 for removing snow and ice from a rail. Such scrapers normally are shaped complementarily to the respective rails to keep them clean. The rails according to the instant invention are always shaped so that they have no flat horizontal surfaces on which snow or ice could easily collect.

FIG. 1 also shows how getting on and getting off the cars can be facilitated by an appropriate speed-equalizing conveyor belt or moving sidewalk 37 controlled if desired by an electric-eye gate 38. Such a system substantially increases the safety of getting on and getting off the car 5. In addition tension-sensitive brakes 46 can be provided along the rails to clamp the traction cable 11 if tension therein drops below a predetermined unsafe level.

Figure 10:
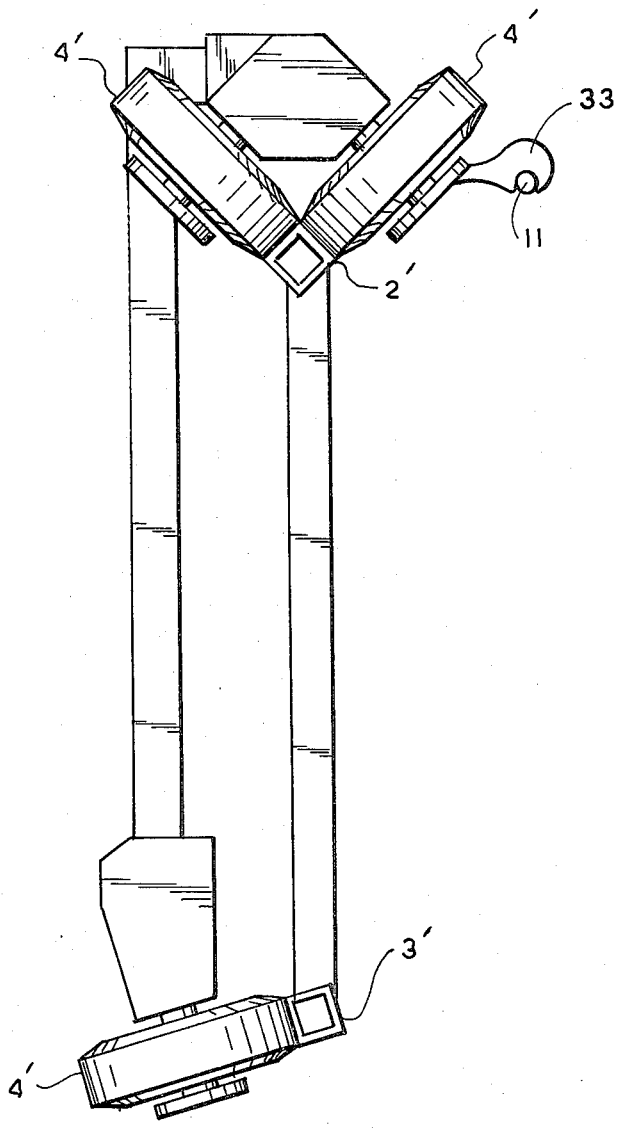
FIG. 10 is a vertical section through a variant on the system of this invention.

Finally FIG. 10 shows an arrangement having square section rails 2' and 3'. The upper rail 2' is engaged by four upper rollers 4', with two against each face, and two lower rollers 4'. These rollers have surfaces which are flat and therefore complementary to the respective flat faces of the rails 2' and 3'.

The rails and struts according to the instant invention may be made of at least partially transparent material to make the system as inconspicuous as possible. A strong and transparent synthetic resin could be used.

I claim:

1. A rail transportation system comprising:

a longitudinally elongated rail assembly including a longitudinally extending upper rail, a longitudinally extending lower rail below said upper rail, and struts interconnecting said rails and rigidly fixing same together as an open box beam;

a flexible traction element extending along said rails;

a car including a car body to one transverse side of said rails and having an outside frame, an inside frame adapted to support a load, and a parallelogrammatic linkage between said frames for maintaining said inside frame horizontal even when said outside frame is tipped, an upper wheel carried on said inside frame to the other transverse side of said rails and riding on said upper rail and bearing on same in one transverse direction toward said car body, a lower wheel carried on said inside frame on said one side of said rails, riding on said lower rail, and bearing on same in a transverse direction generally opposite said one transverse direction, and means for securing said car body to said traction element; and drive means for displacing said traction element longitudinally and thereby advancing said car longitudinally along said rails.

2. The system defined in claim 1 wherein said rail assembly has a pair of parallel sections each with respective upper and lower rails and struts, said rails and struts at said parallel sections being combined in a single such box beam.

3. The system defined in claim 2 wherein said single box beam is generally rectangular in vertical cross section, having upper corners formed by said upper rails and lower corners formed by said lower rails.

4. The system defined in claim 1 wherein said rail assembly has a pair of parallel sections each with respective upper and lower rails and struts, said rail assembly including at said parallel sections at least one additional set of struts rigidly interconnecting said box beams.

5. The system defined in claim 4 wherein said upper rails of said sections are generally at the same horizontal level.

6. The system defined in claim 1 wherein said rail assembly is at least partially transparent.

7. The system defined in claim 1 wherein said rail assembly further includes:

a plurality of longitudinally spaced fixed bases; and means supporting said rails and struts on said bases for limited relative longitudinal displacement.

8. The system defined in claim 7 wherein said means includes a layer of low-friction material between said bases and said rail assembly.

9. The system defined in claim 1 wherein said rails have contoured edges engageable with the respective wheels and said wheels are correspondingly complementarily shaped.

10. The system defined in claim 1 wherein one of said rails is hollow and is provided with a longitudinally extending and tensioned prestressing element.

11. The system defined in claim 1 wherein said wheels are rotatable about respective axes inclined to the horizontal and generally parallel.

12. The system defined in claim 1 wherein said rail assembly includes a guide rail between said upper and lower rails and generally parallel thereto, said parallelogrammatic linkage having a guide roller engaging said guide rail.

13. The system defined in claim 12 wherein at least some of said struts are vertical, said assembly further comprising means for fixing said guide rail at any of a plurality of vertically offset locations along the vertical struts.

14. The system defined in claim 1 wherein said car is formed as a flat tread, said cars being sufficiently closely longitudinally spaced along said element to form a stair.

15. The system defined in claim 1 wherein said car body is formed as a vessel open backwardly in the normal displacement direction of said traction element.

16. The system defined in claim 15 wherein said car body is formed at its rear edge with a ramp.

17. The system defined in claim 1 wherein said traction element is generally only supported by said means on said car body.

18. The system defined in claim 1, further comprising support means on said rail assembly for supporting said traction element between said cars.

19. The system defined in claim 1 wherein said rail assembly has a pair of sections extending between longitudinally spaced turnaround stations, said drive means including at at least one of said turnaround stations a drive wheel coupled to said traction element and having a lower flange forming an arcuate continuation of said lower rails.

20. The system defined in claim 1 wherein a plurality of such cars are spaced apart along said traction element, said system further comprising means including tensioners between said cars for tensioning said traction element.

21. The system defined in claim 20, further comprising means between at least two of said cars for braking and arresting said traction element when tension therein drops below a predetermined limit.

22. The system defined in claim 1 wherein said means for securing said car body to said traction element is releasable.

23. The system defined in claim 1 wherein said traction element is a cable incorporating at least one insulated conductor, whereby control signals or the like can be transmitted along said conductor.

24. The system defined in claim 23 wherein said element includes a plurality of such relatively insulated conductors.

25. The system defined in claim 1 wherein said car is provided with means for scraping ice and snow from said rails.

26. The system defined in claim 1 wherein said car has at least four such upper rollers and at least two such lower rollers.

27. The system defined in claim 1 wherein said rails are tubular.

28. The system defined in claim 27 wherein at least one of said rails is provided with heating means for melting ice and snow thereon.

* * * * *